US006398324B1

(12) United States Patent
Claprood

(10) Patent No.: US 6,398,324 B1
(45) Date of Patent: Jun. 4, 2002

(54) USER STATION ASSEMBLY WITH IMPROVED SECURING AND RELEASING MECHANISM

(75) Inventor: Edward Claprood, Southborough, MA (US)

(73) Assignee: EMC Corporation, Hopkinton, MA (US)

( * ) Notice: Subject to any disclaimer, the term of this patent is extended or adjusted under 35 U.S.C. 154(b) by 0 days.

(21) Appl. No.: 09/528,011

(22) Filed: Mar. 17, 2000

(51) Int. Cl.[7] ..... H05K 7/18

(52) U.S. Cl. ..... 312/223.1; 312/321.5; 248/291.1; 248/292.11

(58) Field of Search ..... 248/591.1, 292.11, 248/299.1, 236; 108/134, 152; 312/321.5, 313, 223.1, 223.2, 223.3, 327, 328

(56) References Cited

U.S. PATENT DOCUMENTS

| | | | | | |
|---|---|---|---|---|---|
| 1,576,034 | A | * | 3/1926 | Butt | |
| 2,441,037 | A | * | 5/1948 | Sherrin | |
| 2,859,595 | A | * | 11/1958 | Murphy et al. | 312/321.5 X |
| 4,718,740 | A | * | 1/1988 | Cox | 312/313 X |
| 5,791,753 | A | * | 8/1998 | Paquin | 312/223.1 X |
| 6,061,966 | A | * | 5/2000 | Nelson et al. | 312/223.1 X |

* cited by examiner

*Primary Examiner*—Janet M. Wilkens
(74) *Attorney, Agent, or Firm*—Chapin & Huang, L.L.C.; David E. Huang

(57) ABSTRACT

A bracket can selectively engage and disengage with a base in order to selectively secure and release a user station (e.g., a laptop computer configured to interface with a computer system) for access by a user (e.g., a system administrator). The use of the bracket enables a user station assembly to store the user station within a computer device cabinet in a compact manner, and subsequently unfold the user station assembly from the computer device cabinet for convenient access. In one arrangement, a user station assembly, includes a base, a support frame and a bracket which is pivotably attached to the support frame. The bracket is arranged to selectively engage and disengage with the base such that (i) when the bracket engages with the base, the bracket secures the support frame with the base and secures a movable portion of a user station with the support frame, and (ii) when the bracket disengages with the base, the bracket releases the support frame from the base and releases the movable portion of the user station from the support frame. Accordingly, the bracket simultaneously can secure the movable portion of the user station with the support frame the base and the support frame with the base, when the user station is not in use. Furthermore, the bracket can release the movable portion of the user station from the support frame the base and the support frame from the base, when a user needs to access the user station.

20 Claims, 5 Drawing Sheets

USER STATION ASSEMBLY WITH IMPROVED SECURING AND RELEASING MECHANISM

BACKGROUND OF THE INVENTION

Some computer systems include a console device that provides a system administrator (e.g., a field service engineer, a maintenance technician, etc.) with local computer system access. The system administrator can use the console device to perform various computer system operations such as run diagnostics, install computer components, and monitor computer system status.

Such computer systems typically locate the console device such that it is out of the way and free from causing isle space interference. For example, in some situations, console devices are located on dedicated console stands (e.g., small desks or tables) which align with the computer device cabinets of the computer system and at a desktop height for convenient access. In such a situation, the system administrator generally can easily reach the console device such as by sitting at a chair adjacent the console stand which can be particularly advantageous when the system administrator must use the console device for an extended period of time.

In other situations, the console devices are located high atop computer device cabinets (e.g., a mainframe cabinet or a disk array cabinet) in order to minimize floor space usage. In such a situation, the system administrator generally must stand in order to reach the console device. Nevertheless, one benefit is that this approach uses less floor space than the approach of locating the console device on a dedicated console stand.

In yet other situations, the console devices are stored within the computer device cabinets, e.g., within door cavities of conventional computer device cabinets. In this situation, the computer device cabinet stores a small table and a console device therein. As such, the console device is kept out of the way until needed by the system administrator. When the system administrator requires access to the console device, the system administrator typically opens the computer device cabinet door, unfolds a small table within the cabinet door, pulls out the console device from a cavity within the cabinet door and rests the console device on the table. Typically, the table positions the console device at a convenient height for the system administrator. When the system administrator no longer needs access to the console device, the system administrator places the console device back into the cabinet door cavity, the folds the table back into the cabinet door and closes the cabinet door.

SUMMARY OF THE INVENTION

Unfortunately, there are some drawbacks to conventional approaches to locating console devices for computer systems. For example, locating console devices on dedicated console stands wastes floor space. Such inefficient use of floor space can be particularly expensive when the computer system resides in a specialized computer room in which the cost of each square foot of computer room floor space is typically at a premium.

Additionally, locating console devices high atop computer device cabinets such as a main frame cabinet or a disk array cabinet typically makes access to such console devices difficult and awkward. For example, a system administrator who is not particularly tall may have difficulty viewing a display of the console device located on top of a main frame cabinet. Moreover, locating a console device high atop the computer device cabinet prevents the system administrator from having the luxury of sitting in a chair to work at the console device. Such a drawback is particularly disadvantageous in a situation that requires the system administrator to spend an extended period of time at the console device.

Furthermore, locating the console device within a conventional cabinet door of a computer system cabinet exposes the console device to the possibility of damage due to potential impacts of the console device with the door, or collisions between the console device and a table designed to support the console device when used by the system administrator. Such impacts can be continuous in nature (e.g., ongoing vibrations from a fan within the cabinet) or occasional but severe (e.g., jolts during shipping of the cabinet). Such impacts can damage the console device thus rendering the console device useless to the system administrator.

In contrast to the above-described conventional approaches to locating console devices, the invention is directed to techniques which use a bracket to selectively engage and disengage with a base in order to selectively secure and release a user station (e.g., a console device configured to control a computer system, a data storage system, etc.) for access by a user (e.g., a system administrator). The use of the bracket permits safe storage of the user station within a computer device cabinet in a compact manner. Additionally, the use of the bracket enables a user to conveniently retrieve the user station from the cabinet and access the user station at a convenient height.

One arrangement of the invention is directed to a user station assembly which includes a base, a support frame and a bracket which is pivotably attached to the support frame. The bracket is arranged to selectively engage and disengage with the base such that (i) when the bracket engages with the base, the bracket secures the support frame with the base and secures a movable portion of a user station with the support frame, and (ii) when the bracket disengages with the base, the bracket releases the support frame from the base and releases the movable portion of the user station from the support frame.

Engagement of the bracket with the base (e.g., a cabinet door) safely secures support frame to the base, and the user station to the support frame. Such a configuration prevents otherwise potentially damaging collisions between the user station and the support frame, and between the user station and the base. Further-more, disengagement of the bracket with the base provides the user with easy and convenient access to the user station.

In one arrangement, the base is a door portion of a computer device cabinet. As such, the user station can be stored within the computer device cabinet (e.g., flush against the support frame which can fold into the door portion) so that it is out of the way and protected when not in use.

In one arrangement, the support frame includes a metallic platform. In this arrangement, the user station is a laptop-shaped input/output (I/O) device (e.g., a laptop computer) which is supported by the metallic platform. Accordingly, the I/O device requires minimal space and can simply reside flush with the metallic platform, e.g., fastened to the metallic platform using VELCRO-like material (i.e., hook and loop fastening material), snaps, etc. Furthermore, the I/O device can be in electrical contact with the metallic platform in order to protect the I/O device against electrostatic discharge (ESD). That is, the metallic platform provides an avenue for distributing or dissipating any ESD that is inadvertently placed on the I/O device.

In one arrangement, the bracket includes a middle portion, a first end portion, and a second end portion. The middle portion separates the first and second end portions. Preferably, the first and second end portions are arranged to pivotably attach to a support frame.

In one arrangement, the middle portion defines a middle portion plane, the first end portion defines a first end portion plane, and the second end portion defines a second end portion plane. In this arrangement, the first and second end portion planes are preferably substantially parallel to each other, and the first and second end portion planes are preferably substantially perpendicular to the middle portion plane. It should be understood that relative terms such as parallel and perpendicular, when used within this document, should be interpreted as meaning substantially parallel, substantially perpendicular, etc.

In one arrangement, the bracket provides surfaces which restrict movement of the user station in each of the X-direction, the Y-direction and the Z-direction. Accordingly, in this arrangement, the bracket holds the user station securely and free from collisions with the support frame and the base.

In one arrangement, the bracket further includes a fastener that selectively locks and unlocks the bracket with the base when the fastener is adjusted. By way of example only, the fastener may include a screw which locks and unlocks the bracket with the base when turned. Accordingly, the fastener can lock the bracket in place to prevent inadvertent disengaging of the bracket with the base (e.g., from inadvertent vibrations such as shaking caused by a continuously operating fan, a sudden jostle during shipping, etc.).

In one arrangement, the bracket includes hook-shaped fingers that insert into respective slots of the base when the bracket engages with the base. The hook-shaped fingers of the bracket provide a simple, effective and low-cost means for engaging and disengaging the bracket with the base.

In one arrangement, at least a portion of the bracket is formed by conductive material which is in electrical contact with the support frame. For example, the bracket may have a metallic surface which electrically connects the user station with the support frame in order to protect the user station from ESD. Moreover, the support frame can be electrically connected to the cabinet door, and the cabinet door in turn can be grounded to provide a ground pathway to the user station.

Another arrangement of the invention is directed to a method for accessing a user station. The method includes the step of moving a bracket from an engaged position with a base, in which the bracket secures a support frame with the base and secures a movable portion of a user station with the support frame, to a disengaged position with the base, in which the bracket releases the support frame from the base and releases the movable portion of the user station from the support frame. The method further includes the steps of moving the support frame relative to the base such that the support frame supports a fixed portion of the user station without use of the bracket, and positioning the movable portion of the user station relative to the fixed portion of the user station in order to access the user station. Accordingly, the user station can be stored within a computer device cabinet in a compact manner, and a user can easily access the user station using the above-described method on an as-needed basis.

In one arrangement, the method further includes the step of adjusting a fastener in order to unlock the bracket from the base prior to moving the bracket from the engaged position to the disengaged position. The fastener prevents inadvertent disengagement of the bracket from the base prior to intentionally disengaging the bracket from the base.

The features of the invention, as described above, may be employed in computer systems and related components such as those manufactured by EMC Corporation of Hopkinton, Mass. For example, the invention may be implemented in a control station monitoring assembly provided within Symmetrix storage cabinets manufactured by EMC Corporation.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF PREFERRED EMBODIMENTS

The invention is directed to techniques which use a bracket to selectively engage and disengage with a base in order to selectively secure and release a user station (e.g., a console device) for access by a user (e.g., a system administrator). The use of the bracket permits safe storage of the user station within a computer device cabinet in a compact manner. Furthermore, the use of the bracket enables a user to conveniently retrieve the user station from the cabinet and access the user station at a convenient height. Such techniques of the invention maybe employed in computerized systems and other related devices such as those manufactured by EMC Corporation of Hopkinton, Mass.

Figure 1:
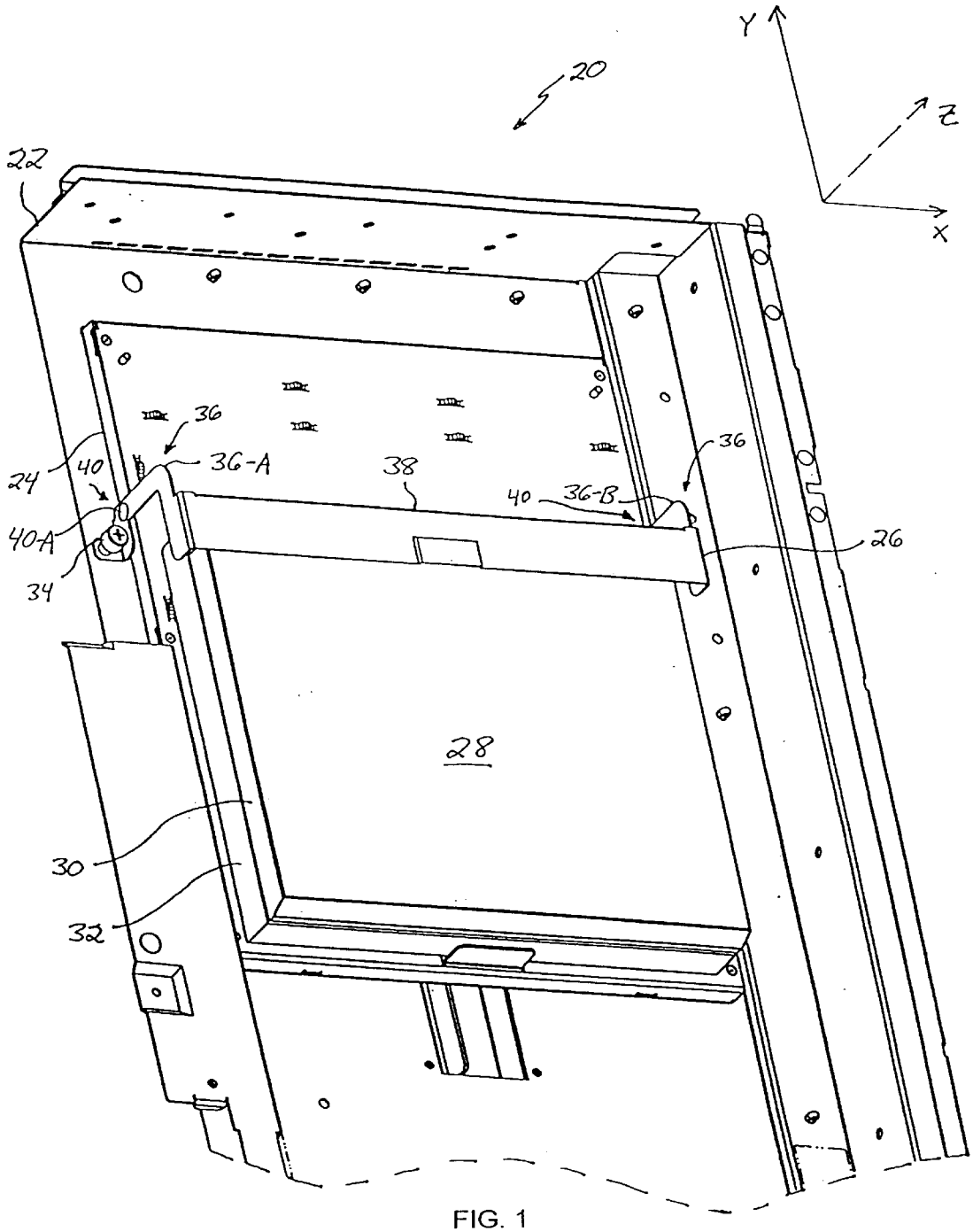
FIG. 1 is a perspective view of a user station assembly, in a closed configuration, having an improved securing and releasing mechanism suitable for use by the invention.

FIG. 1 shows a perspective view of a user station assembly 20 which is suitable for use by the invention. The user station assembly 20 includes a base 22, a support frame 24, and a bracket 26. The components of the user station assembly 20 operate to store a user station 28 in a compact manner, and provide convenient access to the user station 28 when needed. Preferably, the base 22 is a door portion of a computer device cabinet thus enabling storage of the user station 28 within the computer device cabinet when not needed, and enabling easy access (e.g., by opening the door and unfolding the user station assembly 20) when needed.

The user station assembly 20 selectively engages and disengages with the base 22 to selectively secure and release the user station 28 for access by the user. The user station 28 (e.g., a laptop computer configured to interface with a computer system) includes a movable portion 30 (e.g., a display) and a fixed portion 32 (e.g., keyboard, memory, I/O interface, etc.). In general, when the bracket 26 engages with the base 22, the bracket 26 secures the support frame 24 with the base 22 and secures a movable portion 30 of the user station 28 with the support frame 24. On the other hand, when the bracket 26 disengages with the base 22, the bracket 26 releases the support frame 24 from the base 22 and releases the movable portion 30 of the user station 28 from the support frame 24.

The bracket 26 includes a fastener 34 which selectively locks and unlocks the bracket to the base 22 when adjusted. In one arrangement, the fastener 34 includes a threaded member or a screw which locks and unlocks with the base when turned.

The bracket 26 further includes a first end portion 36-A, a second end portion 36-B, and a middle portion 38 which separates the first and second end portions 36-A, 36-B (collectively, end portions 36). As shown in FIG. 1, the end portions 36 define planes that are substantially parallel to the YZ plane. That is, the end portions 36 extend in parallel to the YZ plane. Similarly, the middle portion 38 defines a plane that parallels the XY plane. That is, the middle portion 38 extends substantially in parallel to the XY plane. Accordingly, the planes defined by the end portions 36 (YZ planes) are substantially perpendicular to the plane defined by the middle portion 38 (an XY plane).

It should be understood that each end portion 36 is pivotably attached to the support frame 24 via a pivot joint 40. As shown in FIG. 1, the end portion 36-A is pivotably attached to the support frame 24 via a pivot joint 40-A. This arrangement enables the bracket 26 to conveniently engage and disengage with the base 22 by pivoting relative to the support frame 24 and the base 22. Preferably, the end portions 36 and middle portion 38 of the bracket 26 are metallic such that the user station 28, the bracket 26, the support frame 24 and the base 22 are all electrically connected to avoid ESD hazards.

Figure 2:
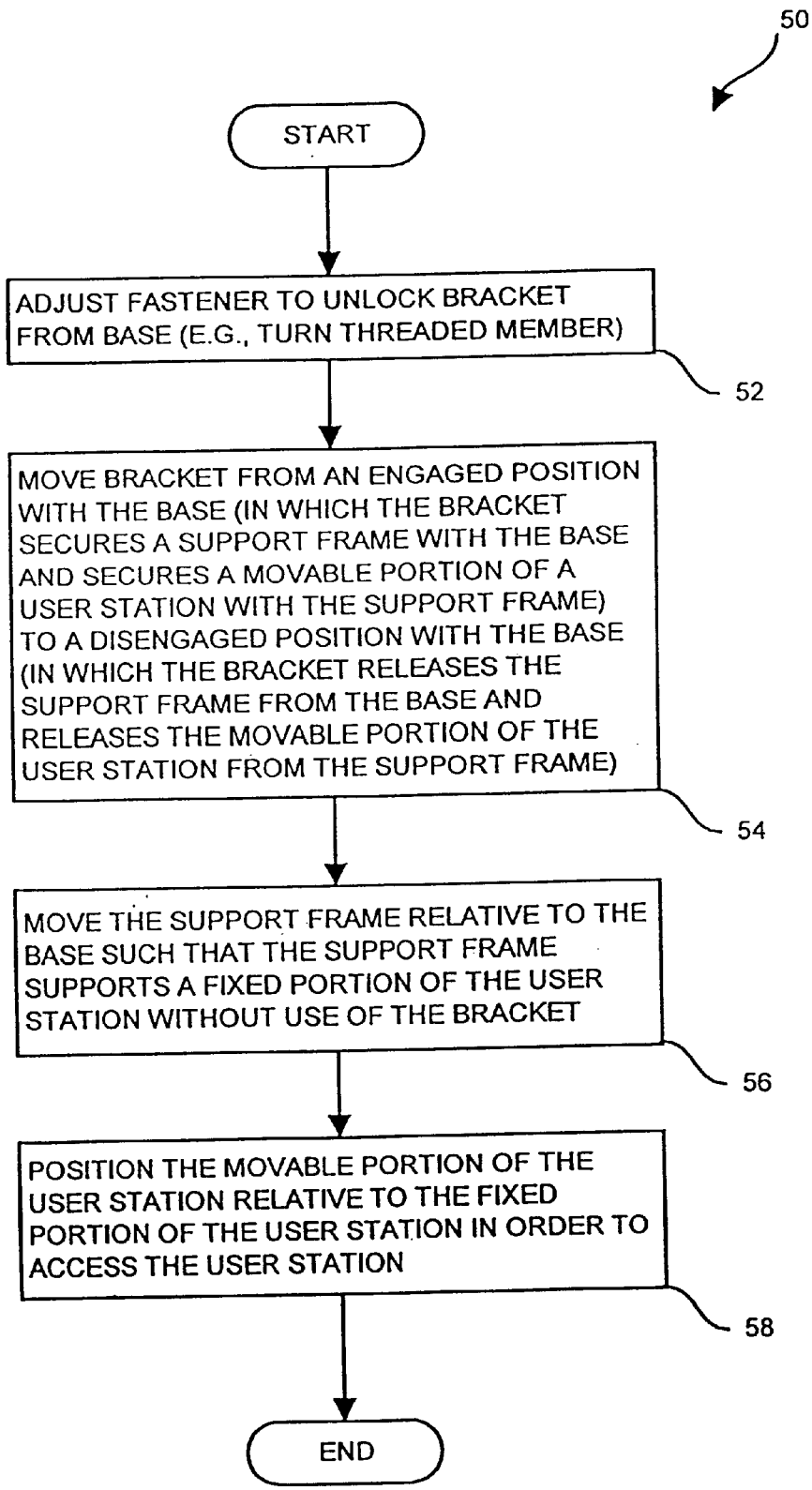
FIG. 2 is a flow diagram illustrating a procedure for accessing the user station of FIG. 1.
Figure 3:
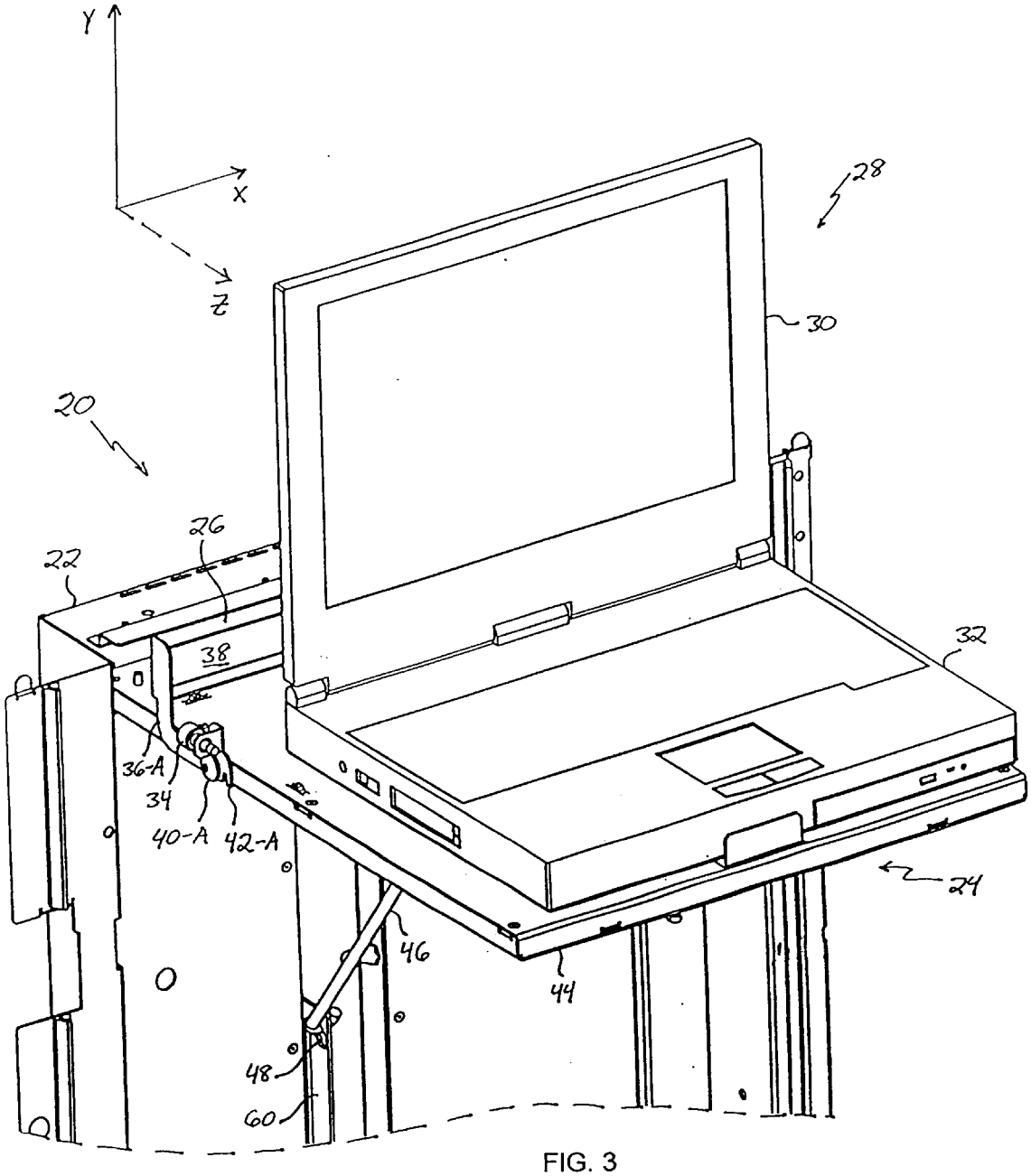
FIG. 3 is a perspective view of the user station of FIG. 1 in an opened configuration.

Further details of the operation of the user station assembly 20 will now be provided with reference to FIGS. 2 and 3. FIG. 2 shows a procedure 50 which is performed by a user (e.g., a system administrator) to transform the user station assembly from a closed configuration, as shown in FIG. 1, to an opened configuration, as shown in FIG. 3. Further details of the procedure 50 will now be provided.

Initially, the bracket 26 engages the base 22 to secure the user station 28 to the support frame 24 and the support frame 24 to the base 22. Furthermore, the fastener 34 initially locks the bracket 26 to the base 22 to prevent inadvertent disengagement of the bracket 22 from the base 22.

In step 52 of the procedure 50, as shown in FIG. 2, the user adjusts the fastener 34 to unlock the bracket 26 from the base 22. In particular, the user turns the fastener 34 until the fastener 34 detaches from the base 22.

In step 54, the user moves the bracket 26 from the engaged position with the base 22 (i.e., in which the bracket 26 secures the movable portion 30 of the user station 28 with the support frame 24, and secures the support frame 24 with the base 22) to a disengaged position (i.e., in which the bracket 26 releases the support frame 24 from the base 22 and releases the movable portion 30 of the user station 28 from the support frame 24). Preferably, the support frame 24 holds at least a portion of the user station 28 (e.g., the support frame 24 holds the fixed portion 32 of the user station 28 using VELCRO-like material) such that the user station 28 is not free to disengage from (e.g., fall out of) the user station assembly 20. FIG. 3 shows a position which is suitable for the disengaged bracket 26 at the completion of step 54.

In step 56, the user moves the support frame 24 relative to the base 22 such that the support frame 24 supports the fixed portion 32 of the user station 28 without use of the bracket 26. A suitable position for the support frame 24 relative to the base 22 is shown in FIG. 3. Here, the support frame 24 is preferably at a convenient height for a user (e.g., at a desktop height so that the user can sit at a chair when accessing the user station 28).

In step 58, the user positions the movable portion 30 of the user station 28 relative to the fixed portion 32 of the user station 28 to access the user station 28. A suitable position for the movable portion 30 relative to the fixed portion 32 is shown in FIG. 3. Here, the movable portion 30 (e.g., a display) is approximately parallel to the XY plane and the fixed portion 32 (e.g., a keyboard, touch mouse, memory, I/O interface, etc.) is approximately parallel to the XZ plane.

As shown in FIG. 3, the user station 20 resides in an opened configuration. The support frame 24 is unfolded from the base 22, and the bracket 26 is moved such that it no longer restricts movement of any portion of the user station 28.

Further details of the users station assembly 20 are shown in FIG. 3. In particular, the fastener 34 is detached from the base 22 but preferably still attached to a portion of the bracket 26 (e.g., end portion 36-A). Additionally, as shown in FIG. 3, the bracket 26 is pivotably attached to the support frame 24 via the pivot joint 40-A (e.g., a screw 40-A, rivot, hinge, etc.). Furthermore, as shown in FIG. 3, the bracket includes fingers 42 (e.g., finger 42-A) which are means for engaging and disengaging with the base 22. The fingers 42 mate with corresponding slots in the base 22 in order to engage with the base 22. FIG. 3 shows finger 42-A in a non-mated (i.e., non-engaged) position relative to the base 22.

As shown in FIG. 3, the support frame 24 includes a metallic tray or platform 44 and a support member 46. When the user station assembly 20 is in the opened configuration, the support member 46 fastens to a slot 48 of an extension 60 of the base 22 when supporting the user station 28 in order position the metallic platform 44 horizontally (i.e., parallel to the XZ plane). When access to the user station 28 is no longer needed, the user can fold the user station assembly 20 back up into the closed configuration (see FIG. 1). This procedure involves closing the portions 30, 32 of the user station 28, disconnecting the support member 46 from the extension 60 (also see FIG. 3), and moving the bracket 26 back over portion 30 of the user station 28 to re-engage the base 22, as shown in FIG. 1.

Figure 4:
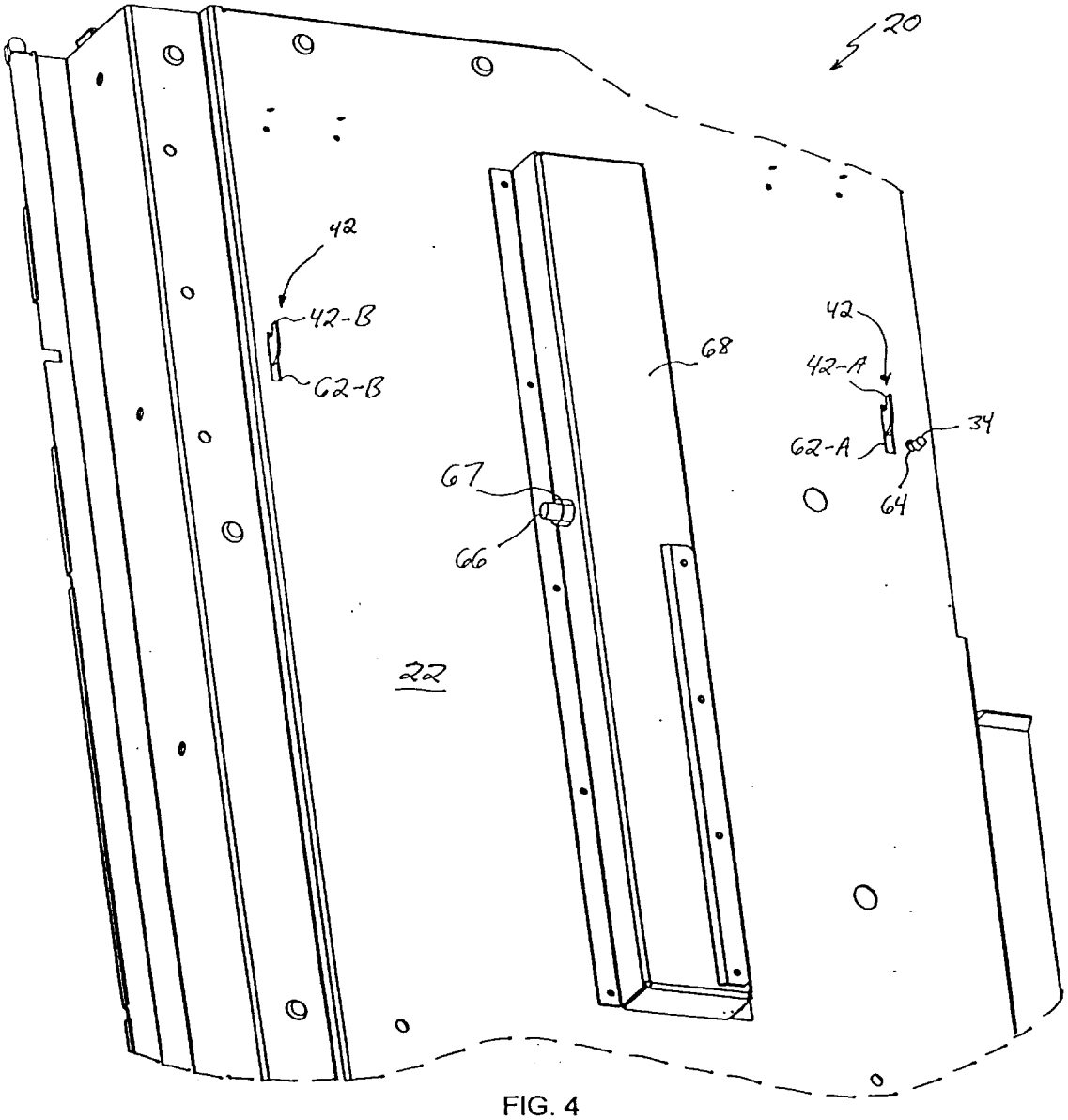
FIG. 4 is a perspective view of a back of a base of the user station assembly of FIG. 1 when the user station assembly is in the closed configuration.

FIG. 4 shows a reverse angle (i.e., the back side) of the user station assembly 20 when the user station assembly 20 is in the closed configuration. In particular, FIG. 4 shows the back of the base 22. Here, the fingers 42-A, 42-B of the bracket 26 engage respective slots 62-A, 62-B of the base 22 to securely hold the support frame 24 to the base 22 and the movable portion 30 of the user station 28 to the support frame 24.

As shown in FIG. 4, the base 22 defines a hole 64 for receiving the fastener 34. By way of example, the fastener 34 includes a screw having an end which is threaded into the hole 64 of the base 22.

As shown in FIG. 4, an end 66 of the support member 46 extends through a hole 67 defined by a portion 68 of the base 22. The portion 68 retains and protects the support member 46 when the user station assembly 20 is in the closed configuration.

Figure 5:
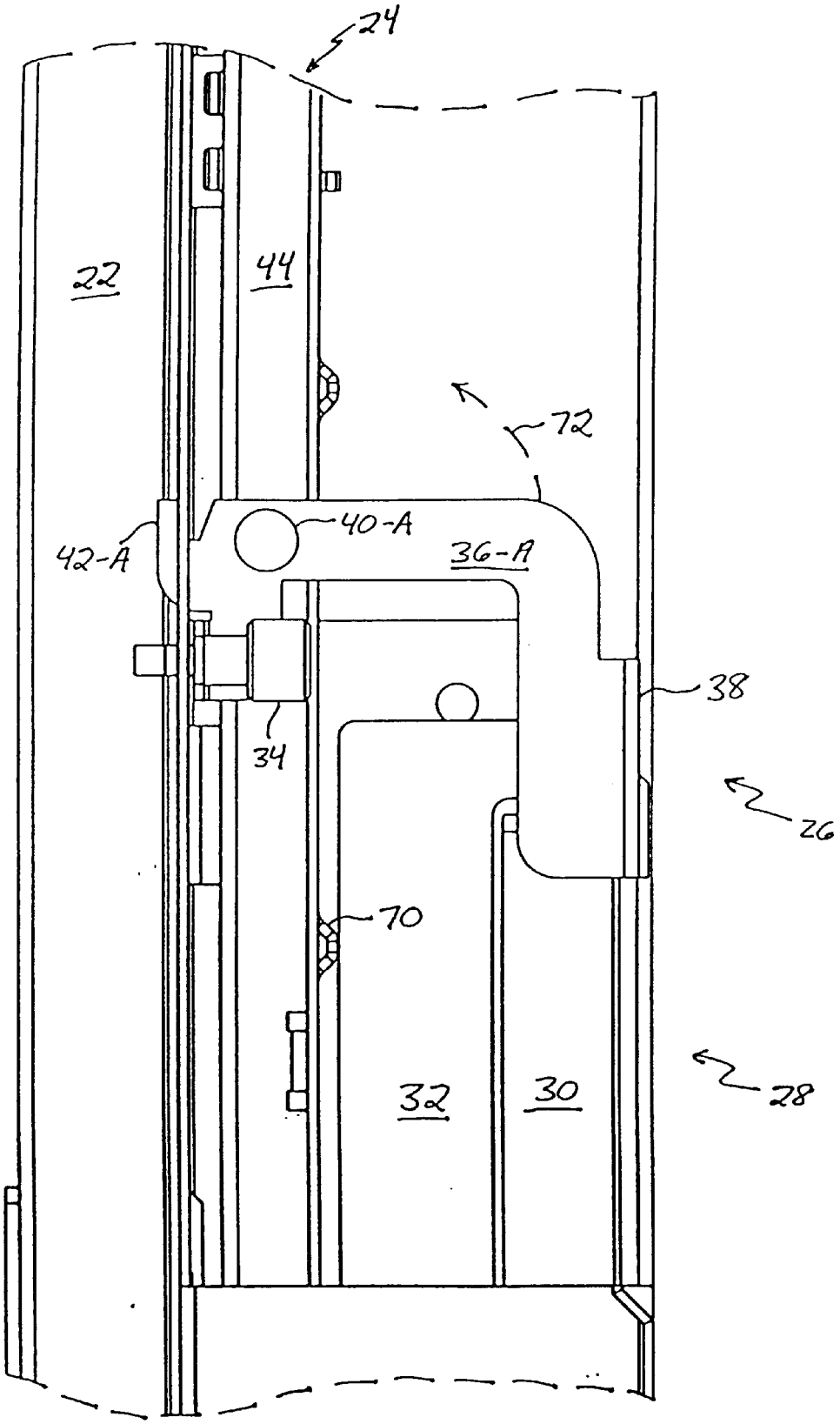
FIG. 5 is a side view of a portion of the user station assembly of FIG. 1 when the users station assembly is in the closed configuration.

FIG. 5 shows a side view of a portion of the user station assembly 20 when the user station assembly 20 is in the closed configuration. As shown, the finger 42-A of the bracket 26 is fully engaged with the base 22 to hold the metallic platform 44 of the support frame 24 securely to the base 22, and to hold the movable portion 30 of the user station 28 securely to the support frame 24. In this position, the user station 28 is both mechanically and electrically protected. That is, the user station assembly 20 is safely held in place by the bracket 26 thus avoiding harmful collisions between the user station 28, and either the support member 24 or the base 22. Additionally, the user station assembly 20 is electrically connected to the support member 24, and preferably the base 22 thus avoiding ESD hazards.

Other details of the invention are illustrated in FIG. 5. In particular, as shown in FIG. 5, the fastener 34 is thoroughly threaded into the base 22 thus locking the bracket 26 to the base 22 and preventing the bracket 26 from inadvertently disengaging from the base 22.

Furthermore, as shown in FIG. 5, a spacer 70 (e.g., a protruding portion of the base 22) positions the user station 28 away from the metallic platform 44 to enable VECLRO-like material to reside between the metallic platform 44 and the user station 28 to secure the fixed portion 32 of the user station 28 to the metallic platform 44. Accordingly, when the bracket 26 disengages with the base 22, the user station 28 does not fall away from the support member 24.

Additionally, as shown in FIG. 5, an arrow 72 shows the direction of movement for the bracket 26 when disengaging the bracket 26 from the base 22 when performing the procedure 50 of FIG. 2. When a user moves the bracket 26 in the direction of the arrow 72 (i.e., in a counterclockwise direction as viewed in FIG. 5), the bracket 26 disengages with the base 22 thus releasing the support frame 24 from the base 22 and releasing the movable portion 30 of the user station 28 from the support frame 24.

As described above, the bracket 26 selectively engages and disengages with the base 22 to enable the user station assembly 20 to store the user station 28 within a computer device cabinet in a compact manner, and subsequently unfold the user station assembly 20 from the computer device cabinet for convenient access. This arrangement enables the user station 28 to be conveniently stored within a computer device cabinet (e.g., the cabinet door) when not in use, and then easily accessed by a user when needed. The features of the invention may be particularly useful in computerized devices manufactured by EMC Corporation of Hopkinton, Mass.

While this invention has been particularly shown and described with references to preferred embodiments thereof, it will be understood by those skilled in the art that various changes in form and details may be made therein without departing from the spirit and scope of the invention as defined by the appended claims.

For example, the user station 28 was described above as a laptop computer by way of example only. The user station 28 can be other types of devices including a palm pilot device, a keyboard, a printer, and personal computer with a flat screen display, etc.

Furthermore, the fastener 34 was described above as including a screw by way of example only. The fastener 34 can further include other components such as a spring to push the screw away from the base 22 once the screw has been turned to the point that it has unlocked itself from the base 22. Additionally, the screw can be any form of lockable or threaded member such as a thumb screw, a keyed lever, etc. Moreover, the fastener 34 can include multiple screws or non-screw-like devices such as a clip, a clamp, a snap, VELCRO-like material (e.g., VELCRO-like pad), etc.

Additionally, it should be understood that the support member 46 does not need to be rod-shaped and connect to the base 22, as shown in FIG. 3. Rather, the support member 46 can be flat or bar-shaped. Additionally, the support member 46 can be one or more legs which unfold and directly contact the floor. Also, the support member 46 can include adjustable features to position the metallic platform 44 substantially horizontally, or at an ergonomically desirable angle.

Furthermore, it should be understood that the portions 36, 38 of the bracket 26 does not need to be substantially flat or planar. Rather, one or more of the portions 36, 38 can have other shapes for added convenience. For example, the middle portion 38 may include a bent portion to enable the user to more easily grab the bracket 26. As another example, the middle portion 38 may include bends to accommodate similar contour changes in the user station, etc.

What is claimed is:

1. A bracket, comprising:

a middle portion;

a first end portion; and a second end portion, wherein the middle portion separates the first and second end portions, wherein the first and second end portions are configured to pivotably attach to a support frame, and wherein the bracket is arranged to selectively engage and disengage with a base when the first and second end portions pivotably attach to the support frame such that:

(i) when the bracket engages with the base, the bracket secures the support frame with the base and secures a movable portion of a user station with the support frame, and (ii) when the bracket disengages with the base, the bracket releases the support frame from the base and releases the movable portion of the user station from the support frame.

2. The bracket of claim 1 wherein the middle portion defines a middle portion plane, wherein the first end portion defines a first end portion plane, wherein the second end portion defines a second end portion plane, wherein the first and second end portion planes are parallel to each other, and wherein the first and second end portion planes are perpendicular to the middle portion plane.

3. The bracket of claim 1 wherein the bracket provides surfaces which restrict movement of the user station in each of the X-direction, the Y-direction and the Z-direction when the first and second portions of the bracket pivotably attach to the support frame and when the bracket engages with the base.

4. The bracket of claim 1, further comprising:

a fastener, coupled to the first end portion, that selectively locks and unlocks the bracket with the base in response to adjustment of the fastener when the first and second portions of the bracket pivotably attach to the support frame and when the bracket engages with the base.

5. The bracket of claim 1 wherein at least one of the first and second end portions includes a hook-shaped finger that inserts into a respective slot of the base when the bracket engages with the base.

6. The bracket of claim 5 wherein each of the first and second end portions includes a hook-shaped finger that inserts into a respective slot of the base when the bracket engages with the base.

7. The bracket of claim 1 wherein at least a portion of the bracket is formed by conductive material which is in electrical contact with the support frame.

8. A bracket, comprising:

a middle portion;

a first end portion;

a second end portion, wherein the middle portion separates the first and second end portions, and wherein the first and second end portions are configured to pivotably attach to a support frame; and means for selectively engaging and disengaging the bracket with a base when the first and second end portions pivotably attach to the support frame such that:

(i) when the bracket engages with the base, the bracket secures the support frame with the base and secures a movable portion of a user station with the support frame, and (ii) when the bracket disengages with the base, the bracket releases the support frame from the base and releases the movable portion of the user station from the support frame.

9. The bracket of claim 8, further comprising:

means for selectively locking and unlocking the bracket with the base when the first and second portions of the bracket pivotably attach to the support frame and when the bracket engages with the base.

10. A user station assembly, comprising:

a base;

a support frame; and a bracket which is pivotably attached to the support frame, the bracket being arranged to selectively engage and disengage with the base such that:

(i) when the bracket engages with the base, the bracket secures the support frame with the base and secures a movable portion of a user station with the support frame, and (ii) when the bracket disengages with the base, the bracket releases the support frame from the base and releases the movable portion of the user station from the support frame.

11. The user station assembly of claim 10 wherein the base is a door portion of a computer device cabinet.

12. The user station assembly of claim 10 wherein the support frame includes a metallic platform, and wherein the user station is a laptop-shaped input/output device which is supported by the metallic platform.

13. The user station assembly of claim 10, wherein the bracket includes:

a fastener that selectively locks and unlocks the bracket with the base when the fastener is adjusted.

14. The user station assembly of claim 10 wherein the bracket includes at least one hook-shaped finger that inserts into a respective slot of the base when the bracket engages with the base.

15. The user station assembly of claim 14 wherein the bracket includes two hook-shaped fingers that insert into respective slots of the base when the bracket engages with the base.

16. The user station assembly of claim 10 wherein at least a portion of the bracket is formed by conductive material which is in electrical contact with the support frame.

17. A user station assembly, comprising:

a base;

a support frame; and a bracket which is pivotably attached to the support frame, the bracket including means for selectively engaging and disengaging the bracket with the base such that:

(i) when the bracket engages with the base, the bracket secures the support frame with the base and secures a movable portion of a user station with the support frame, and (ii) when the bracket disengages with the base, the bracket releases the support frame from the base and releases the movable portion of the user station from the support frame.

18. The user station assembly of claim 17, further comprising:

means for selectively locking and unlocking the bracket with the base.

19. A method for accessing a user station, the method comprising the steps of:

moving a bracket from an engaged position with a base, in which the bracket secures a support frame with the base and secures a movable portion of a user station with the support frame, to a disengaged position with the base, in which the bracket releases the support frame from the base and releases the movable portion of the user station from the support frame;

moving the support frame relative to the base such that the support frame supports a fixed portion of the user station without use of the bracket; and positioning the movable portion of the user station relative to the fixed portion of the user station in order to access the user station.

20. The method of claim 19, further comprising the step of:

prior to the step of moving the bracket, adjusting a fastener in order to unlock the bracket from the base.

* * * * *